US008703677B2

(12) United States Patent
Boffa et al.

(10) Patent No.: US 8,703,677 B2
(45) Date of Patent: Apr. 22, 2014

(54) LUBRICATING OIL COMPOSITIONS FOR INTERNAL COMBUSTION ENGINES

(75) Inventors: Alexander B. Boffa, Oakland, CA (US); Satoshi Hirano, Nagoya (JP); Mark Louis Sztenderowicz, San Francisco, CA (US); Kenji Takeoka, San Refael, CA (US)

(73) Assignees: Chevron Japan Ltd, Tokyo (JP); Chevron Oronite Company LLC, San Ramon, CA (US)

( * ) Notice: Subject to any disclaimer, the term of this patent is extended or adjusted under 35 U.S.C. 154(b) by 1058 days.

(21) Appl. No.: 12/004,567

(22) Filed: Dec. 21, 2007

(65) Prior Publication Data

US 2009/0163393 A1 Jun. 25, 2009

(51) Int. Cl.

| | |
|---|---|
| ***C10M 105/32*** | (2006.01) |
| ***C10M 105/36*** | (2006.01) |
| ***C10M 105/42*** | (2006.01) |
| ***C10M 105/04*** | (2006.01) |

(52) U.S. Cl.
USPC ..... 508/496; 508/475; 508/485; 508/492

(58) Field of Classification Search
USPC ..... 508/459, 466, 472, 475, 485, 496, 492, 508/506
See application file for complete search history.

(56) References Cited

U.S. PATENT DOCUMENTS

| | | | | |
|---|---|---|---|---|
| 3,337,457 | A * | 8/1967 | Fowler et al. | 508/254 |
| 4,968,453 | A | 11/1990 | Wada et al. | |
| 4,994,196 | A | 2/1991 | Kagaya et al. | |
| 5,547,597 | A * | 8/1996 | Koganei et al. | 508/409 |
| 5,942,475 | A | 8/1999 | Schlosberg et al. | |
| 5,965,498 | A | 10/1999 | Smythe | |
| 6,300,290 | B1 | 10/2001 | L'Heureux et al. | |
| 6,462,001 | B1 * | 10/2002 | Kenbeek et al. | 508/492 |
| 6,503,872 | B1 | 1/2003 | Tomaro | |
| 6,605,573 | B1 | 8/2003 | Koganei et al. | |
| 6,649,576 | B2 * | 11/2003 | Bell et al. | 508/481 |
| 6,713,438 | B1 | 3/2004 | Baillargeon et al. | |
| 6,846,782 | B2 | 1/2005 | Calder | |
| 2003/0027727 | A1 * | 2/2003 | Hartley et al. | 508/188 |
| 2003/0186824 | A1 | 10/2003 | Chiu et al. | |
| 2005/0217631 | A1 * | 10/2005 | Muramatsu | 123/196 R |
| 2006/0223718 | A1 | 10/2006 | Bastien et al. | |
| 2009/0186787 | A1 | 7/2009 | Scherer et al. | |

FOREIGN PATENT DOCUMENTS

| | | |
|---|---|---|
| JP | A-2004-277712 | 10/2004 |
| WO | WO 0146350 A1 * | 6/2001 |

OTHER PUBLICATIONS

American Petroleum Institute (API) Publication 1509, Fourteenth Edition, Dec. 1996.
Product Summary for Priolube™ 3970 available from Croda International PIC's website.
Machine translation of JP-A-2004-277712.

* cited by examiner

*Primary Examiner* — Pamela H Weiss
(74) *Attorney, Agent, or Firm* — Jones Day

(57) ABSTRACT

Provided herein are lubricating oil compositions for high performance engines comprising a Group III base oil and a combination of ester base stocks, wherein the combination comprises (i) an ester base stock having a kinematic viscosity at 100° C. of about 2-10 cSt, (ii) an ester base stock having a kinematic viscosity at 100° C. of about 10 to 50 cSt, and (iii) an ester base stock having a kinematic viscosity at 100° C. of greater than about 100 cSt. The lubricating oil composition can further comprise at least one additive. Methods of making and using the lubricating oil compositions are also described.

22 Claims, 4 Drawing Sheets

LUBRICATING OIL COMPOSITIONS FOR INTERNAL COMBUSTION ENGINES

FIELD

Provided herein are lubricating oil compositions for internal combustion engines. The compositions provided herein comprise a Group III base stock and a combination of ester base stocks. Methods of making and using the lubricating oil compositions are also described.

BACKGROUND

High output engines require higher wear protection and less energy loss under extremely severe operating conditions. The lubricant oil compositions for such engines are required to provide extreme pressure performance but without the corrosion impact of other extreme pressure agents. Current racing oils are formulated by modifying conventional oils or lubricating oils used in passenger vehicles. The oils formulated in this manner do not optimally and efficiently meet the performance demands placed on racing oils. Therefore, there is a continuing need for new lubricating oil formulations that are suitable for use in high output engines.

SUMMARY OF THE INVENTION

Provided herein are lubricating oil compositions that provide wear protection and friction reduction to internal combustion engines. In one embodiment, the lubricating oil compositions comprise a Group III base oil and a combination of ester base stocks.

In certain aspects, the Group III base oil is present in an amount greater than about 50%, 60% or about 70% by weight of the lubricating oil compositions.

In certain embodiments, the combination of ester base stocks comprises three or more ester base stocks. In certain embodiments, the combination of ester base stocks comprises three ester base stocks. In certain embodiments, the combination of ester base stocks comprises: (i) an ester base stock having kinematic viscosity of about 2-10 cSt at 100° C., (ii) an ester base stock having kinematic viscosity of about 10 to 50 cSt or greater than 10 to 50 cSt at 100° C. and (iii) an ester base stock having kinematic viscosity of greater than about 100 cSt at 100° C. In certain embodiments, the amount of the combination of ester base stocks in the lubricating oil composition is less than about 50% by weight of the lubricating oil compositions. In certain embodiments, the amount of the combination of ester base stocks in the lubricating oil composition is less than about 45%, about 40% or about 35% by weight of the lubricating oil compositions.

Also provided herein are methods of making lubricating oil compositions. In one aspect, the methods comprise the step of mixing (a) a Group III base oil; and (b) a combination of ester base stocks, wherein the combination comprises: (i) an ester base stock having kinematic viscosity of 2-10 cSt at 100° C., (ii) an ester base stock having kinematic viscosity of greater than 10 to 50 cSt at 100° C. and (iii) an ester base stock having kinematic viscosity of greater than 100 cSt at 100° C. (see lube section D, paragraph 84)

Also provided herein are methods of lubricating an internal combustion engine with lubricating oil compositions provided herein. In one aspect, the methods comprise the step of applying the lubricating oil composition to the engine. In certain embodiments, the lubricating oil compositions provided herein are useful in high output engines, such as racing car engines, sports car engines and others. In one aspect the lubricating oil compositions provide higher wear protection to the high output engines. In another aspect, lubricating oil compositions provide less energy loss under the severe operating conditions of the high output engines.

In some embodiments, the lubricating oil compositions disclosed herein are substantially free of viscosity index improvers. In other embodiments, the lubricating oil compositions disclosed herein are free of viscosity index improvers.

In certain embodiments, the lubricating oil composition disclosed herein further comprises at least one lubricating oil additive selected from the group consisting of antioxidants, antiwear agents, detergents, rust inhibitors, demulsifiers, friction modifiers, multi-functional additives, pour point depressants, foam inhibitors, metal deactivators, dispersants, corrosion inhibitors, thermal stability improvers, dyes, markers, and combinations thereof.

Other embodiments will be in part apparent and in part pointed out hereinafter.

DESCRIPTION OF THE DRAWINGS

FIG. 1 depicts a chart showing the results of MTM traction tests at a SRR (slide/role ratio between ball and disc) of 50% for comparative lubricant compositions and lubricant compositions provided herein.

DEFINITIONS

Figure 1:
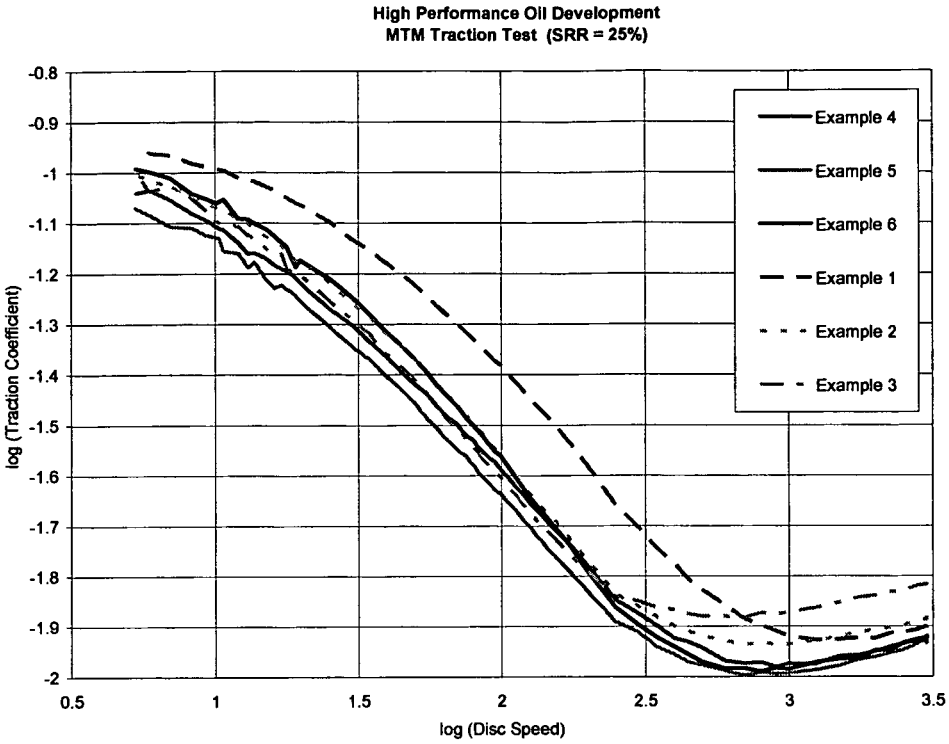
FIG. 1 depicts a chart showing the results of MTM traction tests at a SRR (slide/role ratio between ball and disc) of 25% for comparative lubricant compositions and lubricant compositions provided herein.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

"A major amount" of a base oil refers to the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

"Sulfated ash content" refers to the amount of metal-containing additives (e.g., calcium, magnesium, molybdenum, zinc, etc.) in a lubricating oil and is typically measured according to ASTM D874, which is incorporated herein by reference.

A composition that is "substantially free" of a compound refers to a composition which contains less than 20 wt. %, less than 10 wt. %, less than 5 wt. %, less than 4 wt. %, less than 3 wt. %, less than 2 wt. %, less than 1 wt. %, less than 0.5 wt. %, less than 0.1 wt. %, or less than 0.01 wt. % of the compound, based on the total weight of the composition.

A composition that is "free" of a compound refers to a composition which contains from 0.001 wt. % to 0 wt. % of the compound, based on the total weight of the composition.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$, and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

DESCRIPTION OF EMBODIMENTS

Provided herein are lubricating oil compositions for internal combustion engines comprising a) a Group III base stock and b) a combination of ester base stocks and optionally c) one or more lubricating oil additives, wherein the combination comprises:

(i) an ester base stock having a kinematic viscosity at 100° C. of 2-10 cSt, (ii) an ester base stock having a kinematic viscosity at 100° C. of 10 to 50 cSt or greater than 10 to 50 cSt, and (iii) an ester base stock having a kinematic viscosity at 100° C. of greater than 100 cSt.

A. The Base Stock

The Group III base oil is described in the American Petroleum Institute (API) Publication 1509, 16$^{th}$ Edition, Appendix E. Group III base oils are defined as having the following minimum characteristics: ≥0.03% sulfur, ≥90% saturates, and ≥120 viscosity index, as determined by the ASTM methods listed in Table E.1 of Publication 1509. In one embodiment, the saturates content of the Group III base oil is at least about 95% by weight, and in one embodiment at least about 98% by weight. In one embodiment, the sulfur content is up to about 0.02% by weight, and in another embodiment up to about 0.01% by weight. In one embodiment, the viscosity index of the Group III base oil is about 125, in another embodiment, greater than 130.

The Group III base oil used herein is available from a number of diverse sources. For example, the base oil can be manufactured using a variety of different processes including but not limited to distillation, solvent refining, hydrogen processing, oligomerization, and rerefining. Rerefined stock is typically substantially free from materials introduced through manufacturing, contamination, or previous use.

In one embodiment, the Group III base oil is derived from natural lubricating oils, synthetic lubricating oils or mixtures thereof. The lubricant base oils include base stocks obtained by isomerization of synthetic wax and slack wax, as well as hydrocrackate base oils produced by hydrocracking the aromatic and polar components of the crude oil. Hydrocarbon synthetic oils include, for example, oils prepared from hydrocarbon synthesis procedures using carbon monoxide and hydrogen gases, for example in a Fisher Tropsch process.

In one embodiment, the Group III base oil used herein is derived from natural stocks (as opposed to being derived from synthetic sources), and is refined such that it exhibits the performance and viscosity parameters of synthetic base oils.

In certain embodiments, the natural lubricating oils include animal oils, vegetable oils (e.g., rapeseed oils, castor oils and lard oil), petroleum oils, mineral oils, and oils derived from coal or shale.

The base oil may be derived from unrefined, refined, rerefined oils, or mixtures thereof. In one embodiment, unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the natural and/or synthetic base oil. Such wax isomerate oil is produced by the hydroisomerization of natural or synthetic waxes or mixtures thereof over a hydroisomerization catalyst.

Examples of Group III base oils are disclosed in U.S. Pat. Nos. 6,503,872; 6,649,576; and 6,713,438. Exemplary Group III base oils include UCBO 4R; UCBO 7R; TEXHVI stocks, such as TEXHVI-100N (95% saturates, 125 viscosity index and 0.02% sulfur); TEXHVI-70N (97.8% saturates, 123 viscosity index and 0.02% sulfur); "MOTIVA" TEXHVI 90N-100N (100% saturates, 125 viscosity index and 0.01% sulfur); and "MOTIVA" TEXHVI 75N (100% saturates, 125 viscosity index and 0.0% sulfur). In one embodiment, the Group III base oil used in the lubricant oil compositions provided herein is UCBO 4R or UCBO 7R.

In certain embodiments, the amount of Group III base oil in the lubricant oil compositions provided herein is more than about 40% by total weight of the composition. In certain embodiments, the amount of Group III base oil in the lubricant oil compositions provided herein is more than about 50% by total weight of the composition. In certain embodiments, the amount of Group III base oil in the lubricant oil compositions provided herein is about 50% to about 90% by total weight of the composition. In certain embodiments, the amount of Group III base oil in the lubricant oil compositions provided herein is about 50% to about 70% by total weight of the composition. In certain embodiments, the amount of Group III base oil in the lubricant oil compositions provided herein is about 50% to about 60% by total weight of the composition. In certain embodiments, the amount of Group III base oil in the lubricant oil compositions provided herein is about 45%, 50%, 52%, 54%, 56%, 58%, 60%, 62%, 64%, 66%, 68%, 70%, 75%, 80%, 85% or about 90% by total weight of the composition. In one embodiment, the amount of Group III base oil in the lubricant oil compositions provided herein is about 54% or 58% by total weight of the composition.

B. Combination of Ester Base Stocks

In certain embodiments, the combination of ester base stocks used in the lubricating oil compositions herein comprises at least three ester base stocks. In certain embodiments, the combination of ester base stocks comprises three ester base stocks. In certain embodiments, the combination of ester base stocks comprises: (i) an ester base stock having kinematic viscosity of about 2-10 cSt at 100° C., (ii) an ester base stock having kinematic viscosity of about 10 to 50 cSt at 100°

C. and (iii) an ester base stock having kinematic viscosity of greater than about 100 cSt at 100° C.

In certain embodiments, the combination of ester base stocks used in the lubricating oil compositions herein comprises at least three ester base stocks. In certain embodiments, the combination of ester base stocks comprises three ester base stocks. In certain embodiments, the combination of ester base stocks comprises: (i) an ester base stock having kinematic viscosity of 2-10 cSt at 100° C., (ii) an ester base stock having kinematic viscosity of greater than 10 to 50 cSt at 100° C. and (iii) an ester base stock having kinematic viscosity of greater than about 100 cSt at 100° C.

In certain embodiments, the amount of the combination of ester base stocks in the lubricating oil composition is less than about 50% by weight of the lubricating oil compositions. In certain embodiments, the amount of the combination of ester base stocks in the lubricating oil composition is less than about 50%, about 45%, about 40% or about 35% by weight of the lubricating oil compositions. In certain embodiments, the amount of the combination of ester base stocks in the lubricating oil composition is about 49%, about 47%, about 45%, about 43%, about 40%, about 38%, about 36%, about 34%, about 30%, about 28%, about 25%, about 23%, about 20%, about 15% or about 10% by weight of the lubricating oil compositions. In one embodiment, the amount of the combination of ester base stocks in the lubricating oil composition is about 38% or about 34% by weight of the lubricating oil composition.

Ester Base Stocks Having Kinematic Viscosity of 2-10 cSt at 100° C.

In certain embodiments, the ester base stock having kinematic viscosity of 2-10 cSt at 100° C. comprises an ester of aliphatic dibasic acid having 4-14 carbon atoms and an alcohol having 4-14 carbon atoms. In one embodiment, the aliphatic dibasic acids having 4-14 carbon atoms include succinic acid, glutaric acid, adipic acid, piperic acid, suberic acid, azelaic acid, sebacic acid, undecanedioic acid, dodecanedioic acid, brassilic acid and tetradecanedioic acid. Examples of the alcohols having 4-14 carbon atoms include n-butanol, isobutanol, n-amyl alcohol, isoamyl alcohol, n-hexanol, 2-ethylbutanol, cyclohexanol, n-heptanol, isoheptanol, methylcyclohexanol, n-octanol, dimethylhexanol, 2-ethylhexanol, 2,4,4-trimethylpentanol, isooctanol, 3,5,5-trimethylhexanol, isononanol, isodecanol, isoundecanol, 2-butyloctanol, tridecanol and isotetradecanol.

In one embodiment, the diesters which can be obtained from these aliphatic dibasic acids and alcohols include, for example, di(1-ethylpropyl) adipate, di(3-methylbutyl) adipate, di(1,3-methylbutyl) adipate, di(2-ethylhexyl) adipate, di(isononyl) adipate, di(isodecyl) adipate, di(undecyl) adipate, di(tridecyl) adipate, di(isotetradecyl) adipate, di(2,2,4-trimethylpentyl) adipate, di[mixed (2-ethylhexyl, isononyl)] adipate, di(1-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed (2-ethylhexyl, isononyl)] azelate, di[mixed (2-ethylhexyl, decyl) azelate, di[mixed (2-ethylhexyl, isodecyl)] azelate, di[mixed (2-ethylhexyl, 2-propylheptyl)] azelate, di(n-butyl) sebacate, di(isobutyl) sebacate, di(1-ethylpropyl) sebacate, di(1,3-methylbutyl) sebacate, di(2-methylbutyl) sebacate, di(2-ethylhexyl) sebacate, di[2-(2-ethylbutoxy)ethyl] sebacate, di(2,2,4-trimethylbenzyl) sebacate, di(isononyl) sebacate, di(isodecyl) sebacate, di(isoundecyl) sebacate, di(tridecyl) sebacate, di(isotetradecyl) sebacate, di[mixed (2-ethylhexyl, isononyl)] sebacate, di(2-ethylhexyl) glutarate, di(isoundecyl) glutarate, and di(isotetradecyl) glutarate.

In certain embodiments, these diesters have a kinematic viscosity of 2-7 cSt, in another embodiment, 2.2-6 cSt at 100° C. In one embodiment, the low viscosity ester used in the lubricant oil compositions provided herein is Priolube 3960, a diester based on short chain fatty acids, having a kinematic viscosity at 100° C. of 4.5 cSt.

Ester Base Stocks Having Kinematic Viscosity of About 10 to 50 cSt or Greater Than About 10 to 50 cSt at 100° C.

In certain embodiments, ester base stocks for use in the compositions provided herein have kinematic viscosity of about 10 to 50 cSt at 100° C. In certain embodiments, ester base stocks for use in the compositions provided herein have kinematic viscosity of greater than about 10 to 50 cSt at 100° C. In certain embodiments, the ester base stock having kinematic viscosity of greater than 10 to 50 cSt at 100° C. comprises polyol esters of C5-C15 monocarboxylic acids. In one embodiment the ester base stock having kinematic viscosity of greater than 10 to 50 cSt at 100° C. comprises, for example, pentaerythritol trimethylol propane and neopentyl glycol soluble esters of C5-C15 monocarboxylic acids.

In one embodiment, the ester is an α-olefin/dicarboxylic acid ester copolymer having a viscosity of about greater than 10 to 50 or about 20 to 50 cSt at 100° C., which is represented by formula I:

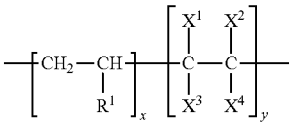

wherein $R^1$ is alkyl; $X^1$, $X^2$, $X^3$ and $X^4$ are each hydrogen, alkyl group, —$R^2$—$CO_2R^3$ or —$CO_2R^4$ wherein $R^2$ is alkylene, $R^3$ and $R^4$ may be the same or different and are each alkyl, any two of $X^1$, $X^2$, $X^3$ and $X^4$ are $CO_2R^4$; and x and y may be the same or different and are each a positive number.

In certain embodiments, the α-olefin/dicarboxylic acid ester copolymer comprises an α-olefin with 3 to 20, in another embodiment, 6 to 18 carbon atoms. Exemplary α-olefins include propylene, 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene and 1-eicosene.

In one embodiment, the α-olefin/dicarboxylic acid ester copolymer comprises dicarboxylic acid having an ethylene linkage. Examples of the dicarboxylic acids include maleic acid, fumaric acid, citraconic acid, mesaconic acid, and itaconic acid. In one embodiment, the dicarboxylic acid forms an ester with an alcohol having 1 to 20 carbon atoms. In another embodiment, the dicarboxylic acid forms an ester with an alcohol having 3 to 8 carbon atoms. Examples of the alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol and eicosanol.

In certain embodiments, the α-olefin/dicarboxylic acid ester copolymer is prepared by copolymerizing the α-olefin with the dicarboxylic acid ester by methods known to one of skill in the art. An exemplary process is described in Japanese Patent Application No. (Sho.) 58-65246. In certain embodiments, the molar ratio of the α-olefin (x) to the ester (y) of a dicarboxylic acid is 1:9 to 9:1. In certain embodiments, the number average molecular weight of the ester copolymer is 1000 to 3000.

In one embodiment, the ester base stock for use herein is "Ketjenlube 135" a butanol ester of an α-olefin maleic acid copolymer having an Mn of 1800 and a viscosity of 35 cSt at 100° C.

Ester Base Stocks Having Kinematic Viscosity of Greater Than About 100 cSt at 100° C.

In certain embodiments, the ester base stock having kinematic viscosity of greater than about 100 cSt at 100° C. is a complex ester base stock. Such complex ester base stocks are known to one of skill in the art. Exemplary complex ester base stocks are described in U.S. Pat. No. 5,942,475. In one embodiment, the complex ester base stock is prepared from:

(1) a polyhydroxyl compound represented by the general formula:

$$R—(OH)_2$$

wherein R is any aliphatic or cyclo-aliphatic hydrocarbyl group and n is at least 2, provided that the hydrocarbyl group contains from about 2 to 20 carbon atoms;

(2) a polybasic acid or an anhydride of a polybasic acid, provided that the ratio of equivalents of the polybasic acid to equivalents of alcohol from the polyhydroxyl compound is in the range between about 1.6:1 to 2:1; and (3) a monohydric alcohol, provided that the ratio of equivalents of the monohydric alcohol to equivalents of the polybasic acid is in the range between about 0.84:1 to 1.2:1.

The polyols for use in the complex ester base stock include, but are not limited to neopentyl glycol, trimethylolethane, trimethylolpropane, trimethylolbutane, mono-pentaerythritol, pentaerythritol, and di-pentaerythritol.

In certain embodiments, the alcohols for use in the complex ester base stocks are, $C_5$ to $C_{13}$ branched and/or linear monohydric alcohol. Exemplary alcohols include, but are not limited to isopentyl alcohol, isohexal alcohol, isoheptyl alcohol, n-heptyl alcohol, iso-octyl alcohol (e.g., 2-ethyl hexanol), n-octyl alcohol, iso-nonyl alcohol (e.g., 3,5,5-trimethyl-1-hexanol), n-nonyl alcohol, isodecyl alcohol, and n-decyl alcohol.

In one embodiment, the polybasic or polycarboxylic acids for use herein include any $C_2$ to $C_{12}$ diacids, e.g., adipic, azelaic, sebacic and dodecanedioic acids. In another embodiment, the anhydrides for use in the complex ester base stock are selected from succinic anhydride, glutaric anhydride, adipic anhydride, maleic anhydride, phthalic anhydride, nadic anhydride, methyl nadic anhydride, hexahydrophthalic anhydride, and mixed anhydrides of polybasic acids.

C. Lubricating Oil Additives

Optionally, the lubricating oil composition may further comprise at least one lubricating oil additive or a modifier (hereinafter designated as "additive") that can impart or improve any desirable property of the lubricating oil composition. Any lubricating oil additive known to a person of ordinary skill in the art may be used in the lubricating oil compositions disclosed herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference. In some embodiments, the lubricating oil additive can be selected from the group consisting of antioxidants, antiwear agents, detergents, rust inhibitors, demulsifiers, friction modifiers, multi-functional additives, pour point depressants, foam inhibitors, metal deactivators, dispersants, corrosion inhibitors, thermal stability improvers, dyes, markers, and combinations thereof.

In general, the concentration of each of the additives in the lubricating oil composition, when used, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

1) Metal Detergents

In some embodiments, the lubricating oil composition provided herein comprises at least a neutral or overbased metal detergent as an additive, or additive components. In certain embodiments, the metal detergents in lubricating oil compositions acts as a neutralizer of acidic products within the oil. In certain embodiments, the metal detergent prevents the formation of deposits on the surface of an engine. Depending on the nature of the acid used, the detergent may have additional functions, for example, antioxidant properties. In certain aspects, lubricating oil compositions contain metal detergents comprising either overbased detergents or mixtures of neutral and overbased detergents. The term "overbased" is intended to define additives which contain a metal content in excess of that required by the stoichiometry of the particular metal and the particular organic acid used. The excess metal exists in the form of particles of inorganic base, e.g. a hydroxide or carbonate, surrounded by a sheath of metal salt. The sheath serves to maintain the particles in dispersion in a liquid oleaginous vehicle. The amount of excess metal is commonly expressed as the ratio of total equivalence of excess metal to equivalence of organic acid and is typically 0.1 to 30.

Some non-limiting examples of suitable metal detergents include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like. An exemplary metal detergent which may be employed in the lubricating oil compositions includes overbased calcium phenate.

Generally, the amount of the metal detergent additive can be less than 10000 ppm, less than 1000 ppm, less than 100 ppm, or less than 10 ppm, based on the total weight of the lubricating oil composition. In some embodiments, the amount of the metal detergent is from about 0.001 wt. % to about 5 wt. %, from about 0.05 wt. % to about 3 wt. %, or from about 0.1 wt. % to about 1 wt. %, based on the total weight of the lubricating oil composition. Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

2) Anti Wear and/or Extreme Pressure Agents

The lubricating oil composition disclosed herein can optionally contain anti wear or extreme pressure agents. Wear occurs in all equipment that has moving parts in contact. Specifically, three conditions commonly lead to wear in engines: (1) surface-to-surface contact; (2) surface contact with foreign matter; and (3) erosion due to corrosive materials. Wear resulting from surface-to-surface contact is friction or adhesive wear, from contact with foreign matter is abrasive wear, and from contact with corrosive materials is corrosive wear. Fatigue wear is an additional type of wear that is common in equipment where surfaces are not only in contact but also experience repeated stresses for prolonged periods. Abrasive wear can be prevented by installing an efficient filtration mechanism to remove the offending debris. Corrosive wear can be addressed by using additives which neutralize the reactive species that would otherwise attack the metal surfaces. The control of adhesive wear requires the use of additives called antiwear and extreme-pressure (EP) agents.

Under optimal conditions of speed and load, the metal surfaces of the equipment should be effectively separated by a lubricant film. Increasing load, decreasing speed, or otherwise deviating from such optimal conditions promote metal-to-metal contact. This contact typically causes a temperature increase in the contact zone due to frictional heat, which in turn leads to the loss of lubricant viscosity and hence its film-forming ability. In certain embodiments, antiwear additive and EP agents offer protection by a similar mechanism. In certain embodiments, EP additives require higher activation temperatures and load than antiwear additives.

Most antiwear and extreme pressure agents contain sulfur, chlorine, phosphorus, boron, or combinations thereof. The classes of compounds that inhibit adhesive wear include, for example, alkyl and aryl disulfides and polysulfides; dithiocarbamates; chlorinated hydrocarbons; and phosphorus compounds such as alkyl phosphites, phosphates, dithiophosphates, and alkenylphosphonates.

Exemplary antiwear agents that can be included in the lubricant oil compositions provided herein include zinc dithiophosphate, metal (e.g., Pb, Sb, Mo and the like) salts of dithiophosphate, metal (e.g., Zn, Pb, Sb, Mo and the like) salts of dithiocarbamate, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-wear agents have been described in Leslie R. Rudnick, "*Lubricant Additives: Chemistry and Applications,*" New York, Marcel Dekker, Chapter 8, pages 223-258 (2003), which is incorporated herein by reference.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphosphorus content. In some embodiments, the phosphosphorus content of the lubricating oil composition disclosed herein is from about 0.01 wt. % to about 0.12 wt. %, from about 0.1 wt. % to about 0.10 wt. %, or from about 0.2 wt. % to about 0.8 wt. %, based on the total weight of the lubricating oil composition.

The dihydrocarbyl dithiophosphate metal salt may be prepared in accordance with known techniques by first forming a dihydrocarbyl dithiophosphoric acid (DDPA), usually by reacting one or more of alcohols and phenolic compounds with $P_2S_5$ and then neutralizing the formed DDPA with a compound of the metal, such as an oxide, hydroxide or carbonate of the metal. In some embodiments, a DDPA may be made by reacting mixtures of primary and secondary alcohols with $P_2S_5$. In other embodiments, two or more dihydrocarbyl dithiophosphoric acids can be prepared where the hydrocarbyl groups on one are entirely secondary in character and the hydrocarbyl groups on the others are entirely primary in character. The zinc salts can be prepare from the dihydrocarbyl dithiophosphoric acids by reacting with a zinc compound. In some embodiments, a basic or a neutral zinc compound is used. In other embodiments, an oxide, hydroxide or carbonate of zinc is used.

In some embodiments, oil soluble zinc dialkyl dithiophosphates may be produced from dialkyl dithiophosphoric acids represented by formula (II):

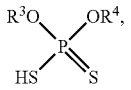

(II)

wherein each of $R^3$ and $R^4$ is independently linear or branched alkyl or linear or branched substituted alkyl. In some embodiments, the alkyl group has from about 3 to about 30 carbon atoms or from about 3 to about 8 carbon atoms.

The dialkyldithiophosphoric acids of formula (II) can be prepared by reacting alcohols $R^3OH$ and $R^4OH$ with $P_2S_5$ where $R^3$ and $R^4$ are as defined above. In some embodiments, $R^3$ and $R^4$ are the same. In other embodiments, $R^3$ and $R^4$ are different. In further embodiments, $R^3OH$ and $R^4OH$ react with $P_2S_5$ simultaneously. In still further embodiments, $R^3OH$ and $R^4OH$ react with $P_2S_5$ sequentially.

Mixtures of hydroxyl alkyl compounds may also be used. These hydroxyl alkyl compounds need not be monohydroxy alkyl compounds. In some embodiments, the dialkyldithiophosphoric acids is prepared from mono-, di-, tri-, tetra-, and other polyhydroxy alkyl compounds, or mixtures of two or more of the foregoing. In other embodiments, the zinc dialkyldithiophosphate derived from only primary alkyl alcohols is derived from a single primary alcohol. In further embodiments, that single primary alcohol is 2-ethylhexanol. In certain embodiments, the zinc dialkyldithiophosphate derived from only secondary alkyl alcohols. In further embodiments, that mixture of secondary alcohols is a mixture of 2-butanol and 4-methyl-2-pentanol.

The phosphorus pentasulfide reactant used in the dialkyldithiophosphoric acid formation step may contain certain amounts of one or more of $P_2S_3$, $P_4S_3$, $P_4S_7$, or $P_4S_9$. Compositions as such may also contain minor amounts of free sulfur. In certain embodiments, the phosphorus pentasulfide reactant is substantially free of any of $P_2S_3$, $P_4S_3$, $P_4S_7$, and $P_4S_9$. In certain embodiments, the phosphorus pentasulfide reactant is substantially free of free sulfur.

In the present invention, the sulfated ash content of the total lubricating oil composition is less than 5 wt. %, less than 4 wt. %, less than 3 wt. %, less than 2 wt. %, or less than 1 wt. %, as measured according to ASTM D874.

In one embodiment, the EP agents for use in the lubricant oil compositions include alkyl and aryl disulfides and polysulfides, dithiocarbamates, chlorinated hydrocarbons, dialkyl hydrogen phosphites, and salts of alkyl phosphoric acids. Methods of making these EP agents are known in the art. For example, polysulfides are synthesized from olefins either by reacting with sulfur or sulfur halides, followed by dehydrohalogenation. Dialkydithiocarbamates are prepared either by neutralizing dithiocarbamic acid (which can be prepared by reacting a diakylamine and carbon disulfide at low temperature) with bases, such as zinc oxide or antimony oxide, or by its addition to activated olefins, such as alkyl acrylates.

In certain embodiments, the lubricating oil compositions comprise one or more EP agents. In one embodiment, use of more that one EP agent leads to synergism. For example, synergism may be observed between sulfur and chlorine-containing EP agents. An exemplary lubricating oil composition provided herein includes one or more EP agents selected from: zinc dialkyldithiophosphate (primary alkyl type & secondary alkyl type), sulfurized oils, diphenyl sulfide, methyl trichlorostearate, chlorinated naphthalene, fluoroalkylpolysiloxane, and lead naphthenate.

3. Rust Inhibitors (Anti Rust Agents)

Protection against rust is an important consideration in formulating lubricants. Without protection, rust ultimately causes a loss of metal, thereby lowering the integrity of the equipment, and resulting in engine malfunction. In addition, corrosion exposes fresh metal that can wear at an accelerated rate, perpetuated by the metal ions that might be released into the fluid and act as oxidation promoters.

The lubricating oil composition disclosed herein can optionally comprise a rust inhibitor that can inhibit the corrosion of metal surfaces. Any rust inhibitor known by a person of ordinary skill in the art may be used in the lubricating oil composition. The rust inhibitors attach themselves to metal surfaces to form an impenetrable protective film, which can be physically or chemically adsorbed to the surface. Specifically, film formation occurs when the additives interact with the metal surface via their polar ends and associate with the lubricant via their nonpolar ends. Suitable rust inhibitors may include, for example, various nonionic polyoxyethylene surface active agents such as polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Suitable rust inhibitors may further include other compounds such as, for example, monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. Further examples of rust agents include metal soaps, fatty acid amine salts, metal salts of heavy sulfonic acid, partial carboxylic acid ester of polyhydric alcohol, and phosphoric ester.

4. Demulsifiers

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. In certain embodiments, the demulsifiers for use herein include block copolymers of propylene oxide or ethylene oxide and initiators, such as, for example, glycerol, phenol, formaldehyde resins, soloxanes, polyamines, and polyols. In certain embodimetns, the polymers contain about 20 to about 50% ethylene oxide. These materials concentrate at the water-oil interface and create low viscosity zones, thereby promoting droplet coalescence and gravity-driven phase separation. Low molecular weight materials, such as, for example, alkali metal or alkaline earth metal salts of dialkylnaphthalene sulfonic acids, are also useful in certain applications. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "*Chemistry and Technology of Lubricants,*" 2nd Edition, London, Springer, Chapter 6, pages 190-193 (1996), which is incorporated herein by reference.

5. Friction Modifiers

The lubricating oil composition disclosed herein can optionally comprise a friction modifier that can lower the friction between moving parts. Any friction modifier known by a person of ordinary skill in the art may be used in the lubricating oil composition. They are typically long-chain molecules with a polar end group and a nonpolar linear hydrocarbon chain. The polar end groups either physically adsorb onto the metal surface or chemically react with it, while the hydrocarbon chain extend into the lubricant. The chains associated with one another and the lubricant to form a strong lubricant film.

Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof.

In one embodiment, the friction modifier is a saturated fatty acid containing a 13 to 18 carbon-atom chain. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "*Chemistry and Technology of Lubricants,*" 2nd Edition, London, Springer, Chapter 6, pages 183-187 (1996); and Leslie R. Rudnick, "*Lubricant Additives: Chemistry and Applications,*" New York, Marcel Dekker, Chapters 6 and 7, pages 171-222 (2003), both of which are incorporated herein by reference.

6. Pour Point Depressants

The lubricating oil composition disclosed herein can optionally comprise a pour point depressant that can lower the pour point of the lubricating oil composition. Any pour point depressant known by a person of ordinary skill in the art may be used in the lubricating oil composition. In certain embodiments, pour point depressants possess one or more structural features selected from: (1) polymeric structure; (2) waxy and non-waxy components; (3) comb structure comprising a short backbone with long pendant groups; and (4) broad molecular weight distribution. Non-limiting examples of suitable pour point depressants include polymethacrylates, alkyl acrylate polymers, alkyl methacrylate polymers, alkyl fumarate polymers, di(tetra-paraffin phenol)phthalate, condensates of tetra-paraffin phenol, condensates of a chlorinated paraffin with naphthalene, alkylated naphthalenes, styrene esters, oligomerized alkyl phenols, phthalic acid esters, ethylene-vinyl acetate copolymers and combinations thereof. In one embodiment, the pour point depressant is selected from tetra (long-chain) alkyl silicates, phenyltrstearyloxysilane, and pentaerythritol tetrastearate. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications,*" New York, Marcel Dekker, Chapter 11, pages 329-354 (2003), both of which are incorporated herein by reference.

7. Foam Inhibitors

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "*Chemistry and Technology of Lubricants,*" 2nd Edition, London, Springer, Chapter 6, pages 190-193 (1996), which is incorporated herein by reference.

8. Metal Deactivators

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

9. Dispersants

The lubricating oil composition disclosed herein can optionally comprise a dispersant that can prevent sludge, varnish, and other deposits by keeping particles suspended in a colloidal state. In certain embodiments, dispersants perform these functions via one or more means selected from: (1) solubilizing polar contaminants in their micelles; (2) stabilizing colloidal dispersions in order to prevent aggregation of their particles and their separation out of oil; (3) suspending such products, if they form, in the bulk lubricant; (4) modifying soot to minimize its aggregation and oil thickening; and (5) lowering surface/interfacial energy of undesirable materials to decrease their tendency to adhere to surfaces. The undesirable materials are typically formed as a result of oxidative degradation of the lubricant, the reaction of chemically reactive species such as carboxylic acids with the metal surfaces in the engine, or the decomposition of thermally unstable lubricant additives such as, for example, extreme pressure agents.

In certain aspects, a dispersant molecule comprises three distinct structural features: (1) a hydrocarbyl group; (2) a polar group; and (3) a connecting group or a link. In certain embodiments, the hydrocarbyl group is polymeric in nature, and has a molecular weight of at or above about 2000 Daltons, in one embodiment, at or above about 3000 Daltons, in another embodiment, at or above about 5000 Daltons, and in yet another embodiment, at or above about 8000 Daltons. A variety of olefins, such as polyisobutylene, polypropylene, polyalphaolefins, and mixtures thereof, can be used to make suitable polymeric dispersants. In certain embodiments, the polymeric dispersant is a polyisobutylene-derived dispersant. Typically the number average molecular weight of polyisobutylene in those dispersants ranges between about 500 and about 3000 Daltons, or, in some embodiments, between about 800 to about 2000 Daltons, or in further embodiments, between about 1000 to about 2000 Daltons. In certain embodiments, the polar group in the dispersant is nitrogen- or oxygen-derived. Nitrogen-based dispersants are typically derived from amines. The amines from which the nitrogen-based dispersants are derived are often polyalkylenepolyamines, such as, for example, diethylenetriamine and triethylenetetramine. Amine-derived dispersants are also called nitrogen- or amine-dispersants, while those derived from alcohol are also called oxygen or ester dispersants. Oxygen-based dispersants are typically neutral while the amine-based dispersants are typically basic.

Non-limiting examples of suitable dispersants include alkenyl succinimides, alkenyl succinimides modified with other organic compounds, alkenyl succinimides modified by post-treatment with ethylene carbonate or boric acid, succiamides, succinate esters, succinate ester-amides, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants, benzylamines, Mannich type dispersants, phosphorus-containing dispersants, and combinations thereof. The amount of the dispersant may vary from about 0.01 wt. % to about 10 wt. %, from about 0.05 wt. % to about 7 wt. %, or from about 0.1 wt. % to about 4 wt. %, based on the total weight of the lubricating oil composition. Some suitable dispersants have been described in Mortier et al., "*Chemistry and Technology of Lubricants,*" 2nd Edition, London, Springer, Chapter 3, pages 86-90 (1996); and Leslie R. Rudnick, "*Lubricant Additives: Chemistry and Applications,*" New York, Marcel Dekker, Chapter 5, pages 137-170 (2003), both of which are incorporated herein by reference.

10. Anti-Oxidants

Optionally, the lubricating oil composition disclosed herein can further comprise an additional antioxidant that can reduce or prevent the oxidation of the base oil. Any antioxidant known by a person of ordinary skill in the art may be used in the lubricating oil composition. Examples of anti oxidants useful in the present invention include, but are not limited to, phenol type (phenolic) oxidation inhibitors, such as 4,4' methylene bis(2,6 di tert butylphenol), 4,4' bis(2,6 di tert-butylphenol), 4,4' bis(2 methyl 6 tert butylphenol), 2,2' methylene bis(4-methyl 6 tert butylphenol), 4,4' butylidene bis(3 methyl 6 tert butylphenol), 4,4' isopropylidene bis(2,6 di tert butylphenol), 2,2' methylene bis(4-methyl 6 nonylphenol), 2,2' isobutylidene bis(4,6 dimethylphenol), 2,2' 5 methylene bis(4 methyl 6 cyclohexylphenol), 2,6 di tert butyl 4-methylphenol, 2,6 di tert butyl 4 ethylphenol, 2,4 dimethyl 6 tert butyl-phenol, 2,6 di tert 1 dimethylamino p cresol, 2,6 di tert 4 (N,N'-dimethylaminomethylphenol), 4,4' thiobis(2 methyl 6 tert butylphenol), 2,2'-thiobis(4 methyl 6 tert butylphenol), bis(3 methyl 4 hydroxy 5 tert-10 butylbenzyl) sulfide, and bis(3,5 di tert butyl 4 hydroxybenzyl). Diphenylamine type oxidation inhibitors include, but are not limited to, alkylated diphenylamine, phenyl alpha naphthylamine, and alkylated alpha naphthylamine, sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. Other types of oxidation inhibitors include metal dithiocarbamate (e.g., zinc dithiocarbamate), and 15 methylenebis(dibutyldithiocarbamate). The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York, Marcel Dekker, Chapter 1, pages 1-28 (2003), which is incorporated herein by reference.

11. Multifunctional Additives

Various additives mentioned or not mentioned herein can provide a multiplicity of effects to the lubricant oil composition provided herein. Thus, for example, a single additive may act as a dispersant as well as an oxidative inhibitor. Multifunctional additives are well known in the art. Other suitable multi-functional additives may include, for example, sulfurized oxymolybdenum dithiocarbamate, sulfurized oxymolybdenum organo phosphoro-dithioate, oxymolybdenum monoglyceride, amine-molybdenum complex compound, and sulfur-containing molybdenum complex compounds.

12. Viscosity Index Improvers

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

D. Processes of Preparing Lubricating Oil Compositions

The lubricating oil compositions disclosed herein can be prepared by any method known to a person of ordinary skill in the art for making lubricating oils. In some embodiments, the base oil is blended or mixed with the ester base stocks and optionally an additive. In certain embodiments, the ester base stocks are premixed followed by addition of the base oil. The combination ester base stocks and the optional additives may be added to the base oil individually or simultaneously. In some embodiments, the combination of ester base stocks and the optional additives are added to the base oil individually in one or more additions and the additions may be in any order. In other embodiments, the ester base stocks and the additives are added to the base oil simultaneously. In one embodiment the ester base stock having a kinematic viscosity of 2-10 cSt and or the ester base stock having a kinematic viscosity of greater than 10 to 50 cSt is added to the group III base oil prior to the addition of the ester base stock having a kinematic viscosity of greater than 100 cSt.

Any mixing or dispersing equipment known to a person of ordinary skill in the art may be used for blending, mixing or solubilizing the ingredients.

E. Applications of the Lubricating Oil Compositions

In certain embodiments, the lubricating oil compositions provided herein are suitable for high output engines, for example those found in racing cars and sports cars. In one embodiment, the lubricant oil compositions herein provide higher wear protection and less energy loss under extremely severe operating conditions for the high output engines. In one embodiment, the extreme pressure performance of such engines is evidenced by improvement in Falex Test (ASTM D 3233 Method B). In one embodiment, the lubricant oil compositions minimize or eliminate the corrosion impact of other extreme pressure agents in the lubricant oil composition by minimizing or eliminating the use of such agents. In certain embodiments, the lubricant oil formulations provided herein improve the shear stability of the oil. In one embodiment, the lubricant compositions herein improve oil pressure stability.

The following examples are presented to exemplify embodiments of the lubricant oil compositions provided herein but are not intended to limit the subject matter to the specific embodiments set forth. Unless indicated to the contrary, all parts and percentages are by weight. All numerical values are approximate. When numerical ranges are given, it should be understood that embodiments outside the stated ranges may still fall within the scope of the claimed subject matter. Specific details described in each example should not be construed as necessary features of the claimed subject matter.

EXAMPLES

In the Examples, the base oils listed below are used in the lubricant compositions:

TABLE 1

| Base Stock | Kinematic Viscosity at 40° C. (cSt) | Kinematic Viscosity at 100° C. (cSt) | Viscosity Index |
|---|---|---|---|
| Chevron UCBO 4R | 19 | 4.1 | 127 |
| Chevron UCBO 7R | 39 | 7.0 | 135 |
| Priolube 3960 | 19.0 | 4.5 | 163 |
| Ketjenlube 135 | 344.2 | 34.2 | 142 |
| Priolube 3986 | 47000 | 2000 | 278 |

Chevron UCBO 4R and UCBO 7R are commercially available Group III base oils. Priolube 3960, a di-ester based on saturated short chain fatty acids, is a low viscosity synthetic ester base stock which is commercially available from Croda. Ketjenlube 135, a butanol ester of an α-olefin/maleic acid copolymer with a molecular weight of about 1800, is a medium viscosity synthetic ester base stock which is commercially available from Akzo Nobel. Priolube 3986, a complex ester, is a high viscosity synthetic ester base stock which is commercially available from Croda.

Comparative Examples 1-3

The lubricating oil compositions of comparative examples 1-3 were prepared according to the formulations provided in Table 1. The compositions of examples 1-3 were adjusted to three different SAE (Society of Automotive Engineers) viscosity grades by the addition of varying amounts of a non-dispersant viscosity index improver, and/or varying the ratios of two Group III base stocks. These lubricating oil compositions contain a major amount of one or more Group III base stocks and no synthetic ester base stocks.

Inventive Examples 4-6

The lubricating oil compositions of examples 4-6, prepared according to the formulations provided in Table 1, were adjusted to three different viscosity grades by the addition of varying amounts of a high viscosity synthetic ester base stock (Priolube 3986). These lubricating oil compositions contain a major amount of one or more Group III base stocks and a combination of a low, a medium and a high viscosity synthetic ester base stock.

Extreme Pressure Wear Test Performance

The Falex Test (ASTM D3233 Method B) is a bench test which measures the extreme pressure properties of fluid lubricants. This method comprises running a rotating steel journal at 290±10 rpm against two stationary V-blocks immersed in the lubricant sample. Load is applied to the V-blocks by a ratchet mechanism. In Test Method B, load is applied in 250-lbf (1112-N) increments with load maintained constant for 1 min at each load increment. The fail load value obtained is the criteria for the level of load-carrying properties.

A summary of the viscosity the viscosity properties and extreme pressure wear protection performance of Examples 1-6 is provided in Table 2.

TABLE 2

| | Examples | | | | | |
|---|---|---|---|---|---|---|
| | 1 | 2 | 3 | 4 | 5 | 6 |
| SAE Oil Viscosity | 5W30 | 0W20 | 10W40 | 0W20 | 5W20 | 5W30 |
| Additive Package 1[1] (wt %) | 9.1 | 9.1 | 9.1 | — | — | — |
| Additive Package 2[2] (wt %) | — | — | — | 8.25 | 8.25 | 8.25 |
| Antiwear (wt %) | 0.80 | 0.22 | 0.80 | | | |
| Friction modifier (wt %) | 0.30 | 0.70 | 0.30 | | | |
| Foam inhibitor (wt %) | 0.02 | 0.02 | 0.02 | | | |
| Non-dispersant olefin copolymer VII[3] (wt %) | 8.69 | 5.35 | 8.00 | — | — | — |
| Priolube 3960 (wt %) | — | — | — | 18.00 | 18.00 | 18.00 |
| Ketjenlube 135 (wt %) | — | — | — | 14.00 | 14.00 | 14.00 |
| Priolube 3986 (wt %) | — | — | — | 2.00 | 4.00 | 6.00 |
| Chevron UCBO 4R (wt %) | 51.49 | 74.59 | | 57.75 | 55.75 | 53.75 |
| Chevron UCBO 7R (wt %) | 29.59 | 10.02 | 81.77 | — | — | — |
| Kinematic viscosity at 100° C. (cSt) | 10.49 | 7.59 | 13.47 | 7.06 | 8.26 | 9.55 |
| Kinematic viscosity at 40° C. (cSt) | 58.51 | 39.2 | 86.19 | 36.52 | 43.89 | 51.66 |
| Viscosity index | 171 | 165 | 159 | 159 | 166 | 172 |
| HTHS at 150° C. (cP) | 3.05 | 2.57 | 3.70 | 2.79 | 3.10 | 3.58 |
| HTHS at 100° C. (cP) | 6.90 | 5.34 | 8.68 | 5.79 | 6.10 | 7.44 |
| HTHS at 50° C. (cP) | 23.91 | 17.93 | 31.84 | 19.55 | 22.61 | 26.51 |
| CCS at −35° C. (cP) | — | 4585 | — | 5650 | — | — |
| CCS at −30° C. (cP) | 3405 | — | | | 4190 | 5518 |
| CCS at −25° C. (cP) | | | 4223 | | | |
| Falex Test[4] (ASTM D3233 B) | | | | | | |
| 1st fail load (lb) | 1250 | 1250 | | 2000 | 2250 | 3250 |
| 2nd fail load (lb) | 1250 | 1250 | | 2000 | 4500 | 1750 |
| 3rd fail load (lb) | — | — | — | — | 3500 | 3750 |

[1]Additive package contains a borated dispersant, an ethylene carbonate post-treated dispersant, an overbased detergent, a zinc-containing anti-wear agent, a molybdenum-containing friction modifier, an ashless friction modifier, an anti-oxidant, a foam inhibitor and diluent oil.
[2]Additive package contains a borated dispersant, an ethylene carbonate post-treated dispersant, an overbased detergent, a mixture of two zinc-containing anti-wear agents, two molybdenum-containing friction modifiers, a foam inhibitor and diluent oil.
[3]Ethylene-propylene copolymer viscosity index improver available from Chevron Oronite Compnay LLC.
[4]A third test was run only when first and second results were different.

As demonstrated by the data, the lubricant compositions of examples 4-6 show higher HTHS at 150° C. which are useful for wear protection at extreme conditions. Examples 4-6 also show better load-carrying properties as evidenced by improvement in the Falex extreme pressure wear test.

Friction Test Performance

Figure 2:
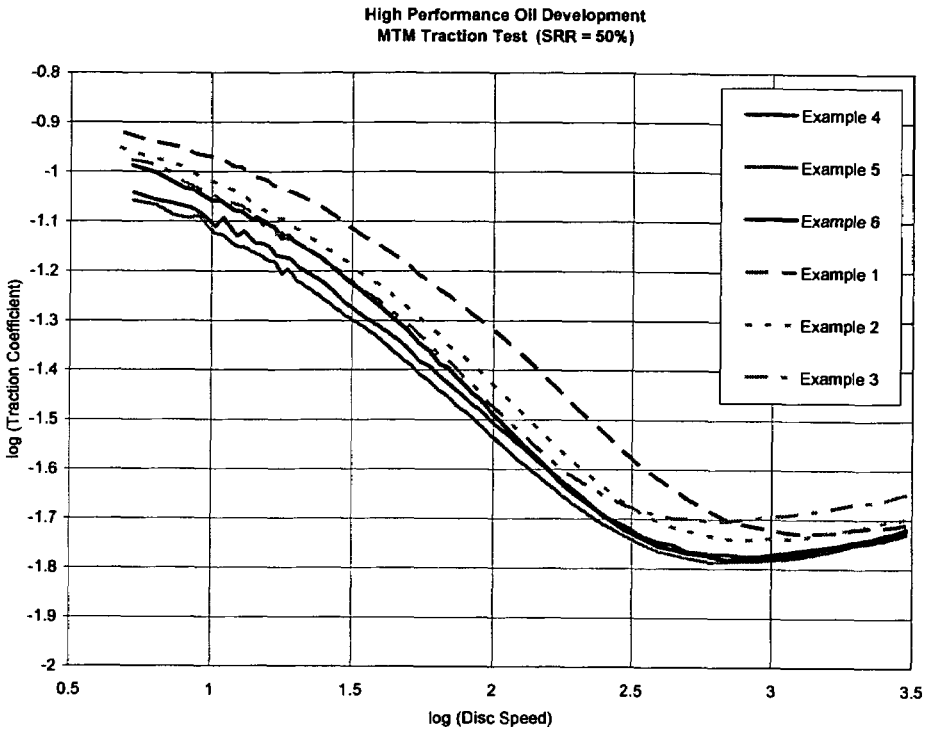
Figure 3:
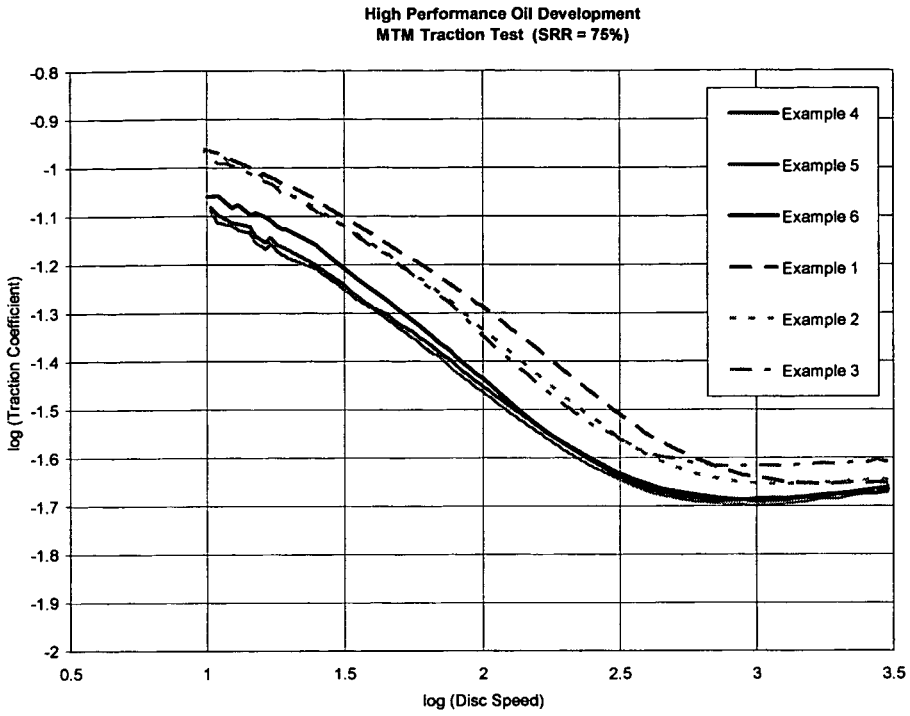
FIG. 3 depicts a chart showing the results of MTM traction tests at a SRR (slide/role ratio between ball and disc) of 75% for comparative lubricant compositions and lubricant compositions provided herein.
Figure 4:
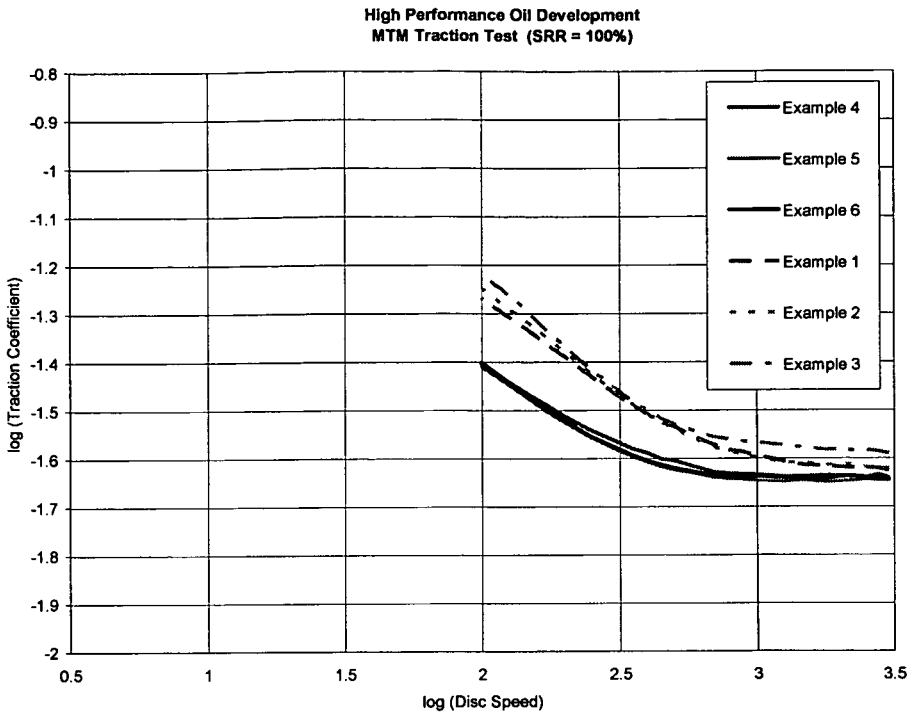
FIG. 4 depicts a chart showing the results of MTM traction tests at a SRR (slide/role ratio between ball and disc) of 100% for comparative lubricant compositions and lubricant compositions provided herein.

Traction Coefficients for comparative lubricant oil compositions of Example 1, Example 2 and Example 3 and the lubricant oil compositions of Example 4 Example 5 and Example 6 were measured using a Mini Traction Machine (MTM) Test System. The tests were conducted at slide to roll ratios of 25%, 50%, 75% and 100% (defined as the difference in sliding speed between the ball and disk divided by the mean speed of the ball and disk. SRR=(Speed1−Speed2)/((Speed1+Speed2)/2)). Each oil's traction coefficient data was plotted against disc speed. The plots are provided in FIGS. 1-4.

As demonstrated in FIGS. 1-4, the compositions of Examples 4-6 show lower traction coefficient at any disc speed as compared with the comparative lubricant oil compositions of Examples 1-3.

While the lubricant oil compositions provided herein have been described with respect to a limited number of embodiments, the specific features of one embodiment should not be attributed to other embodiments of the subject matter claimed herein. No single embodiment is representative of all aspects of the claimed subject matter. In some embodiments, the methods may include numerous steps not mentioned herein. In other embodiments, the methods do not include, or are substantially free of, steps not enumerated herein. Variations and modifications from the described embodiments exist. It is noted that the methods for producing the compositions disclosed herein are described with reference to a number of steps. These steps can be practiced in any sequence. One or more steps may be omitted or combined but still achieve substantially the same results. The appended claims intend to cover all such variations and modifications as falling within the scope of the claims.

All publications and patent applications mentioned in this specification are herein incorporated by reference to the same extent as if each individual publication or patent application was specifically and individually indicated to be incorporated by reference. Although the foregoing has been described in some detail by way of illustration and example for purposes of clarity of understanding, it will be readily apparent to those of ordinary skill in the art in light of the teachings herein that certain changes and modifications may be made thereto without departing from the spirit or scope of the appended claims.

What is claimed is:

1. A lubricating oil composition comprising a Group III base oil; and a combination of ester base stocks, wherein the combination comprises:

(a) an ester base stock having kinematic viscosity of 2-10 cSt at 100° C., wherein the ester base stock comprises a diester based on short chain fatty acids, (b) an ester base stock having kinematic viscosity of greater than 10 to 50 cSt at 100° C., wherein the ester base stock (b) comprises a polymer ester, and (c) an ester base stock having kinematic viscosity of greater than 100 cSt at 100° C., wherein the ester base stock (c) comprises a complex ester, wherein the Group III base oil is present in more than about 50% by weight, the ester base stock (a) is present in about 10% to about 25% by weight, the ester base stock (b) is present in about 10% to about 20% by weight, and the ester base stock (c) is present in about 1% to about 10% by weight.

2. The lubricating oil composition of claim 1, wherein the Group III base oil is about 58% by the total weight of the lubricating oil composition.

3. The lubricating oil composition of claim 1, wherein the Group III base oil is about 54% by the total weight of the lubricating oil composition.

4. The lubricating oil composition of claim 1, wherein the Group III base oil has kinematic viscosity of 4.1 cSt or 7 cSt at 100° C.

5. The lubricating oil composition of claim 1, wherein the combination of ester base stocks is less than about 50% by weight of the total weight of the lubricating oil composition.

6. The lubricating oil composition of claim 1, wherein the combination of ester base stocks is about 38% by weight of the total weight of the lubricating oil composition.

7. The lubricating oil composition of claim 1, wherein the combination of ester base stocks is about 36% by weight of the total weight of the lubricating oil composition.

8. The lubricating oil composition of claim 1, wherein the combination of ester base stocks is about 34% by weight of the total weight of the lubricating oil composition.

9. The lubricating oil composition of claim 1, wherein the ester base stock (a) comprises a diester based on short chain fatty acids having a kinematic viscosity at 100° C. of 4.5 cSt.

10. The lubricating oil composition of claim 1, wherein the ester base stock (b) comprises a butanol ester of an α-olefin/maleic acid copolymer.

11. The lubricating oil composition of claim 1, wherein the ester base stock (b) comprises a polymer ester having kinematic viscosity of 34 cst at 100° C.

12. The lubricating oil composition of claim 1, wherein the ester base stock (c) comprises a complex ester having kinematic viscosity of 2000 cSt at 100 C.

13. The lubricating oil composition of claim 1, wherein the amount of ester base stock (a) is about 18% by weight of the total weight of the composition.

14. The lubricating oil composition of claim 1, wherein the amount of ester base stock (b) is about 14% by weight of the total weight of the composition.

15. The lubricating oil composition of claim 1, wherein the amount of ester base stock (c) is about 2% by weight of the total weight of the composition.

16. The lubricating oil composition of claim 1, wherein the amount of ester base stock (c) is about 4% by weight of the total weight of the composition.

17. The lubricating oil composition of claim 1, wherein the amount of ester base stock (c) is about 6% by weight of the total weight of the composition.

18. The lubricating oil composition of claim 1 further comprising at least one additive selected from the group consisting of antioxidants, antiwear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers and combinations thereof.

19. A method of making a lubricating oil composition comprising the step of mixing:

(i) a Group III base oil; and (ii) a combination of ester base stocks, wherein the combination comprises (a) an ester base stock having kinematic viscosity of 2-10 cSt at 100° C., wherein the ester base stock comprises a diester based on short chain fatty acids, (b) an ester base stock having kinematic viscosity of greater than 10 to 50 cSt at 100° C., wherein the ester base stock (b) comprises a polymer ester, and (c) an ester base stock having kinematic viscosity of greater than 100 cSt at 100° C., wherein the ester base stock (c) comprises a complex ester, wherein the Group III base oil is present in more than about 50% by weight, the ester base stock (a) is present in about 10% to about 25% by weight, the ester base stock (b) is present in about 10% to about 20% by weight, and the ester base stock (c) is present in about 1% to about 10% by weight.

20. A method of lubricating a high output engine comprising the step of operating the engine with the lubricating oil composition of claim 1.

21. The method of claim 20, wherein the high output engine is a race car engine or a sports car engine.

22. The method of claim 20, wherein the high output engine is a race motorcycle engine or a sports motorcycle engine.

* * * * *